US005411171A

United States Patent [19]

Quirling et al.

[11] Patent Number: 5,411,171

[45] Date of Patent: May 2, 1995

[54] APPARATUS FOR AND METHOD OF GENTLY PACKAGING A PRODUCT

[75] Inventors: Jens Quirling, Schwarmstedt; Hejo Frerichs, Verden, both of Germany

[73] Assignee: Lieder Maschinenbau GmbH & Co KG, Germany

[21] Appl. No.: 88,556

[22] Filed: Jul. 6, 1993

[30] Foreign Application Priority Data

Jul. 4, 1992 [DE] Germany ..... 42 22 062.9

[51] Int. Cl.[6] ..... B67B 7/00

[52] U.S. Cl. ..... 222/1; 222/56; 222/559; 222/564

[58] Field of Search ..... 222/56, 547, 564, 559, 222/1

[56] References Cited

U.S. PATENT DOCUMENTS 5,092,490 3/1992 Suzuki et al. ..... 222/56

*Primary Examiner*—Gregory L. Huson

*Attorney, Agent, or Firm*—Henry M. Feiereisen

[57] ABSTRACT

An apparatus and method for gently packaging a product having a consistency which can be affected by external influences and is composed of a plurality of separable components which are advanced along a transport path, includes a plurality of rods which are movable in longitudinal direction between a first position in which the rods extend transversely to the transport path and a second position in which the rods are withdrawn from the transport path. By alternating the back and forth movement between successively arranged rods, product components can descend in increments to thereby accomplish a separation of product components and loosening of the product.

41 Claims, 4 Drawing Sheets

APPARATUS FOR AND METHOD OF GENTLY PACKAGING A PRODUCT

BACKGROUND OF THE INVENTION

The present invention refers to an apparatus for and method of gently packaging a product, and in particular to an apparatus for and method of loosening a product of a type which can be affected by external influences and is composed of a plurality of separable components tending to adhere to one another.

Such an apparatus and such a method are required in connection with making and packaging prepared foods in order to gently loosen batches of cooked products which are stored in containers and to separate the product components before being placed on a conveyor for transfer to a metering device and packaging device. In particular, noodles adhere to one another or agglomerate to varying degrees in dependence on their shape and time passed since the cooking procedure. In addition, some types of noodles such as spaghetti or macaroni tend additionally to become entangled. Attempts to mechanically separate these products which are very sensitive to external influences resulted almost always in impaired appearance of the product in the packaging containers. This, however, should be avoided.

SUMMARY OF THE INVENTION

It is an object of the present invention to provide an improved apparatus for and improved method of gently packaging a product, obviating the aforestated drawbacks.

In particular, it is an object of the present invention to provide an apparatus for and method of by which the conveyed product is gently loosened up and separated into its components without any deformation.

These objects and others which will become apparent hereinafter are attained in accordance with the present invention by admitting in the transport path of the product at least one rod which is movably supported in its longitudinal direction for allowing a shifting between a first position in which the rod extends across the transport path and a second position in which the rod is withdrawn from the transport path so as to thereby free the cross sectional area thereof.

In this manner, the rod, which is shiftable across the transport path and retractable therefrom, serves as a retention element by which an undesired escape of product components from the transport path is prevented. Preferably, a plurality of rods are successively arranged along the transport path, with rods being jointly withdrawn from the transport path so that product components can descend in direction toward an outlet opening of the transport path until being caught by subjacent rods which remain in their position across the transport path, or being discharged through the outlet opening. The retracted rods are then returned to their position in front of the outlet opening to serve as retention element for picking up subsequently descending product components. Through respectively alternating the movement of successive rods, the product components can advance in increments. Since some rods always remain completely or partially in a position in front of the outlet opening, an uncontrolled exit of product components from the container is prevented. The incremental descent of product components results in a separation of the components and attains a desired loosening of the product.

The provision of longitudinally movable rods enables a gentle treatment of the product as the rods easily penetrate between the product components when admitted across the transport path i.e. transversely to the moving direction of the product. Suitably, the free ends of the rods are of pointed or rounded configuration to further facilitate a penetration between the product components.

According to a further feature of the present invention, at least some of the rods extend parallel to each other and are arranged in rows, with at least two rows of rods being successively disposed in moving direction of the product. Suitably, the rods of one row are jointly operated, with rods of a succeeding and/or preceding row remaining in their position in front of the outlet opening. Subsequently, i.e. after the previously retracted row of rods is returned to its position in front of the outlet opening, the preceding or succeeding row of rods can then be withdrawn separately or together from the transport path.

Suitably, rods or rows of rods can be shifted from different directions to a position in front of the outlet opening. Advantageously, the rods or rows of rods are shifted from opposite directions across the transport path in front of the outlet opening.

In accordance with a preferred embodiment of the present invention, the time sequence for a shift of one row of rods away from and back again in front of the outlet opening is carried out before a successive row of rods is operated, with the distance between successively shifted rows of rods increasing in moving direction or at least remaining constant. Thus, a withdrawal of rods allows product components previously retained by these rods to sufficiently descend in moving direction so that these product components will not interfere when these rods are readmitted across the transport path. A subsequent falling or sliding of further product components from the container is prevented by the immediately preceding row of rods.

In accordance with the present invention, a method of gently packaging a product includes admitting a plurality of neighboring and successively arranged rods across the transport path, with one fraction of rods being withdrawable from the transport path to release product components previously retained by these rods while maintaining the position of the other fraction of rods in a position across the transport path. Advantageously, the rows of rods are arranged in such a manner that the one fraction of row of rods engages or is positioned between rows of rods of the other fraction of row of rods. In this manner, the product components descend in increments by being repeatedly freed and retained to thereby improve the loosening effect.

It is also possible to control the movement of the rods in such a manner that a conveyor belt which passes beneath the outlet opening is continuously charged, with the movement of the rods being controlled such that an opening is created which travels in synchronism with the conveying speed of the belt and through which the product components advance in direction toward the outlet opening and eventually onto the conveyor belt. Thus, the rods can be arranged as to be movable transversely to as well as in conveying direction of the belt.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
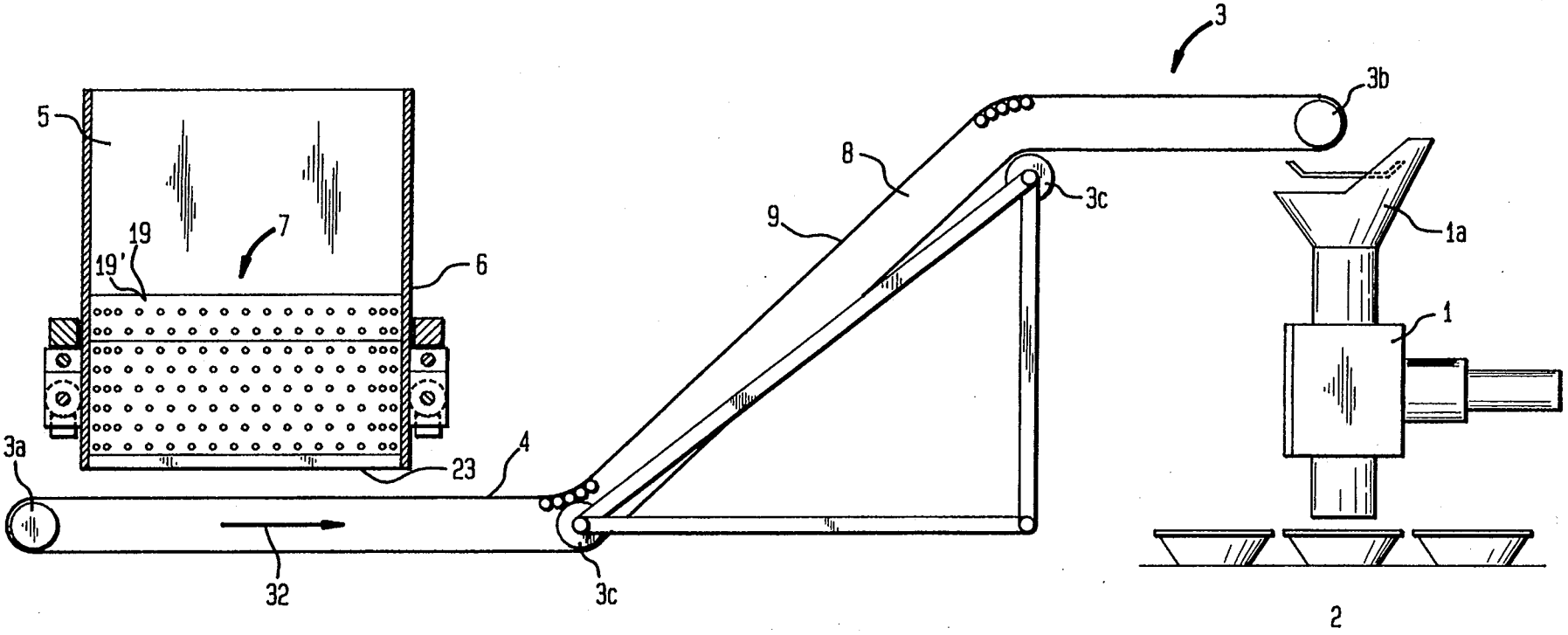
FIG. 1 is a schematic and simplified side view of a packaging arrangement for prepared foods, with schematic illustration of one embodiment of an apparatus for loosening and discharging product components of the prepared foods, in accordance with the present invention.

Throughout all the Figures, the same or corresponding elements are always indicated by the same reference numerals.

Referring now to the drawing and in particular to FIG. 1, there is shown a schematic and simplified side view of a packaging arrangement for prepared foods, including a feeder 1 by which the product, i.e. prepared foods, are metered before being filled into packing units 2 which may be in form of cup-shaped containers. The feeder 1 is supplied with product from a feed hopper la which continuously receives product from a conveyor, generally designated by reference numeral 3 and travelling in conveying direction as indicated by the arrow 32. The conveyor 3 is of the belt-type, with the endless belt 9 travelling about a drive pulley 3*a* and a return pulley 3*b*. As shown in the nonlimiting example of FIG. 1, the belt 9 of the conveyor 3 travels along two horizontal sections between which an upward incline 8 is positioned. Although not shown in the drawing, the incline 8 may be provided with suitable carrier plates to assist in keeping the product from slipping on the incline 8. Suitable idler pulleys 3*c* are provided to properly deflect and guide the belt 9.

It will be appreciated by persons skilled in the art that the conveyor 3 must contain additional mechanical apparatus, e.g. a drive mechanism, which does not appear in the foregoing Figures. However, this apparatus, like other necessary apparatus, is not part of the present invention, and has been omitted from the Figures for the sake of simplicity.

Arranged above the carrying run 4 of the conveyor belt 9 is a loosening and discharging apparatus which includes a container 5 with an upper funnel-shaped top 5*a* and a lower discharge well 6 defined by broad side walls 19, 19' which extend parallel to the conveying direction of the conveyor 3. The discharge well 6 includes an inlet opening at the junction to the funnel-shaped top 5*a* of the container 5 and an outlet opening 23. Cooperating with the discharge well 6 is a loosening device, generally designated by reference numeral 7 by which the product, such as noodles, which has been stored in the interim within the container 5, is loosened and disentangled before being charged onto the conveyor 3 to ensure an even loading of the conveyor 3 and to prevent formation of lumps of product components which could otherwise slip downwards on the incline 8 via the carrier plates and accumulate in the junction area of the horizontal conveyor path to the inclined conveyor path.

Figure 2:
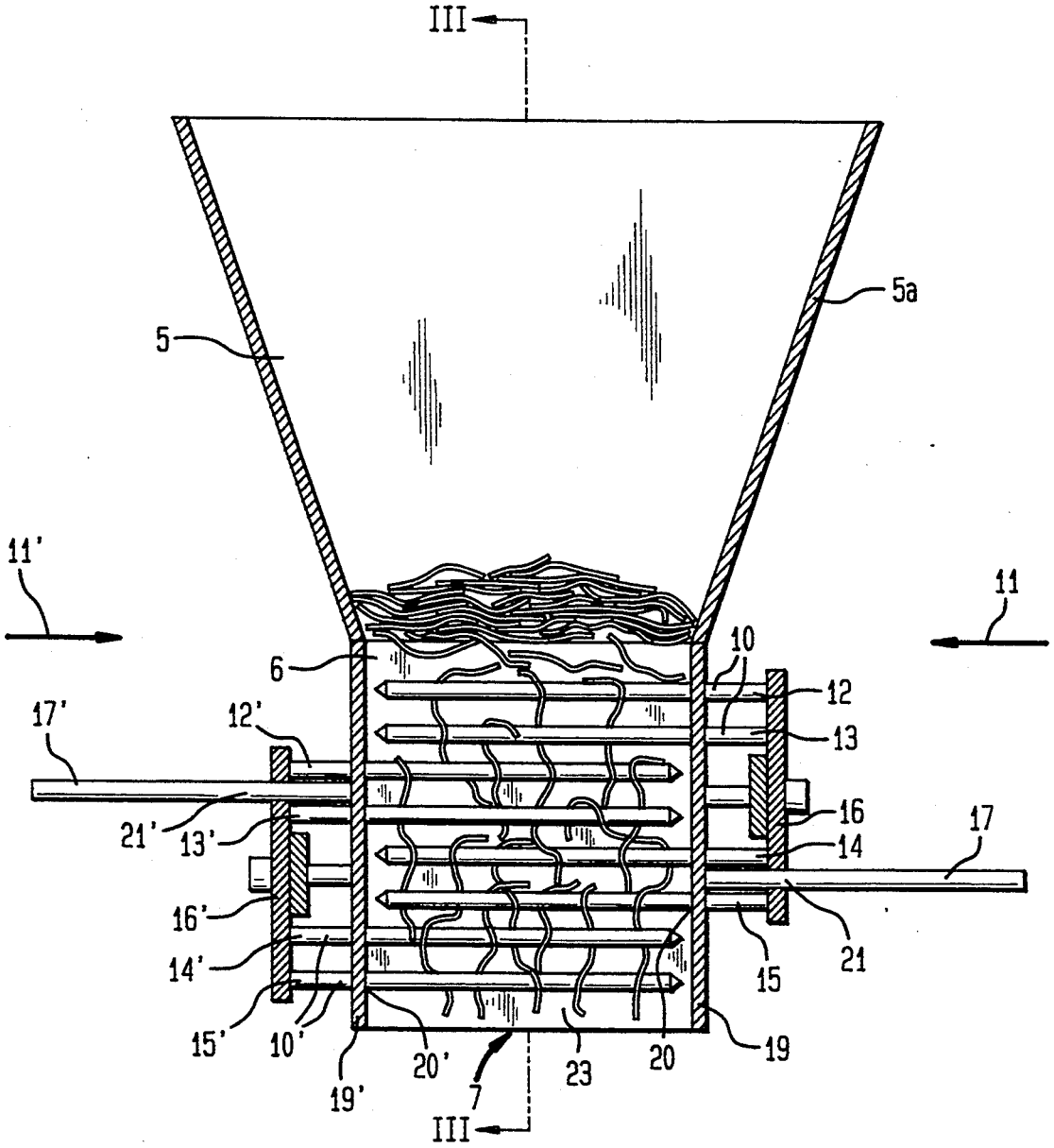
FIG. 2 is a longitudinal section through the loosening apparatus of FIG. 1.
Figure 3:
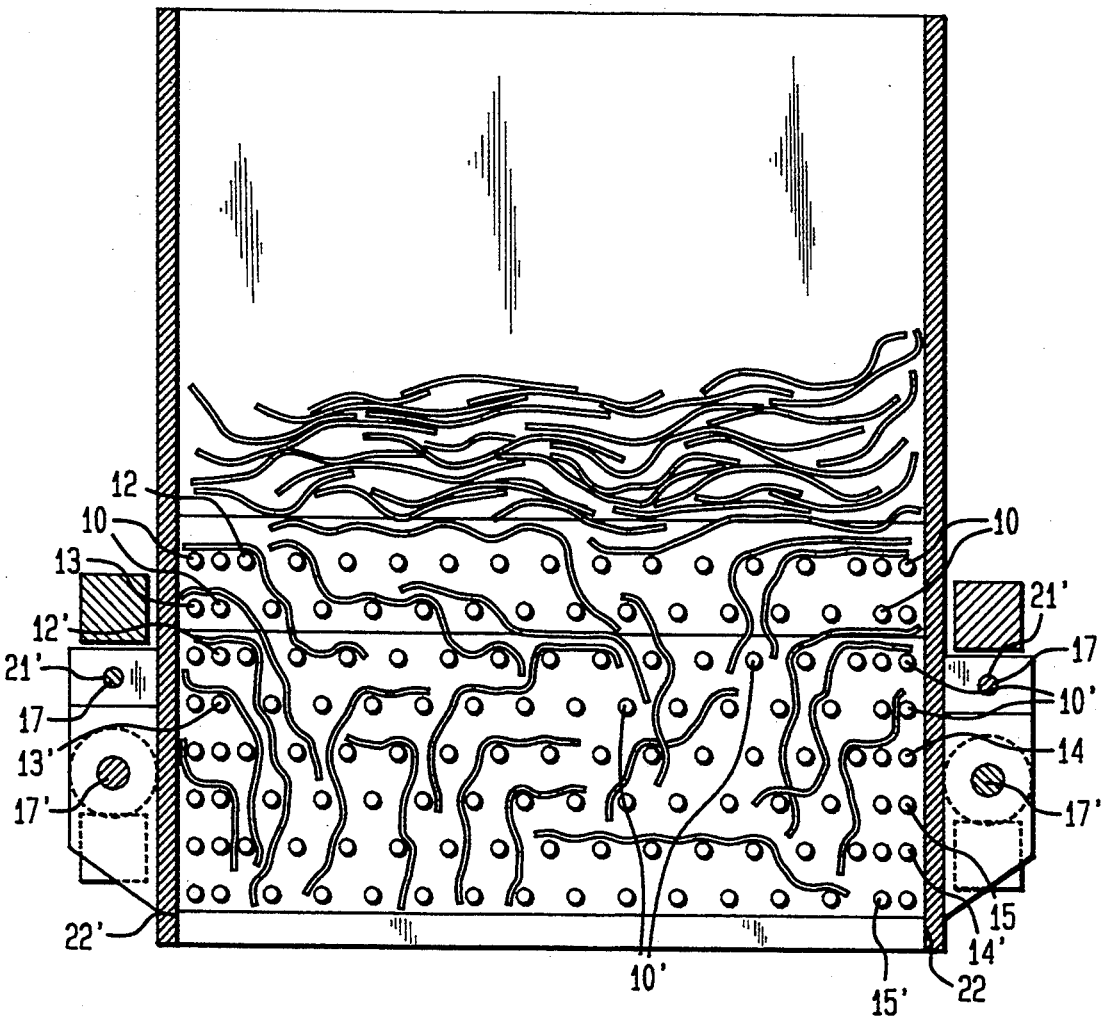
FIG. 3 is a longitudinal section of the loosening apparatus taken along the line III—III in FIG. 2.

Turning now to FIG. 2, there is shown a longitudinal section through the loosening device 7 which includes essentially a plurality of slender rods 10, 10' which are spread over the entire cross section of the discharge well 6 and are of rounded configuration, with their free ends being pointed to facilitate penetration through the product. As best seen in conjunction with FIG. 3, the loosening device 7 has a number of successively arranged rows 12, 12', 13, 13', 14, 14', 15, 15' of parallel rods 10, 10', with the rods 10 of the first double row 12, 13 and third double row 14, 15 being mounted to a common support plate 16 and with the rod 10' of the second double row 12', 13' and fourth or last double row 14', 15' being mounted to a common support plate 16'. Suitably, as best seen in FIG. 3, the rods 10, 10' of successive rows are arranged offset relative to one another, with the spacing between rods 10, 10' of successive rows being constant. Alternatively, as shown in FIG. 4 in connection with a modification of the loosening device 7, the spacing between rods 10, 10' of successive rows may also increase in moving direction of the product components.

Figure 4:
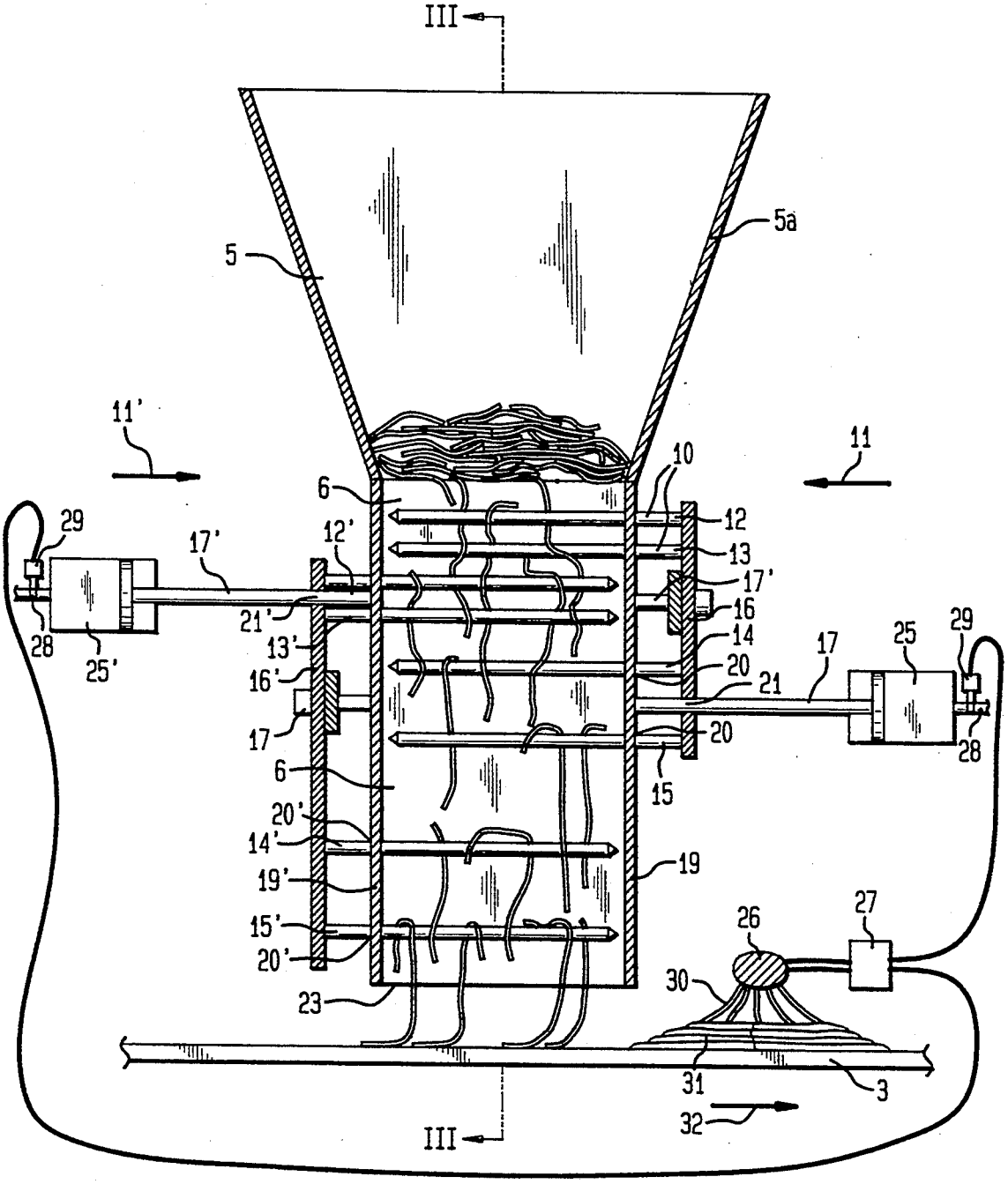
FIG. 4 is a simplified, schematic longitudinal section of another embodiment of a loosening apparatus according to the present invention.

Each of the support plates 16, 16' is detachably secured to the free end of two push rods 17, 17' which are part of a drive mechanism including pneumatic cylinders, such as pneumatic cylinders 25, 25' (FIG. 4). By means of the push rods 17, 17', the support plates 16, 16' and thus the rows of rods 10, 10' can be shifted from opposite directions as indicated by arrows 11, 11' (FIG. 2) toward the opposing broad side walls 19, 19' between a first end position in which the rods 10, 10' substantially traverse the discharge well 6 and a second end position in which the rods 10, 10' are completely withdrawn from the discharge well 6. The side walls 19, 19' are suitably provided with bores 20, 20' for allowing passage of the rods 10, 10'.

As best seen in FIG. 2, the push rods 17, 17' are guided for displacement in longitudinal direction in bores 21, 21' of the other support plate 16, 16' and along the outside of the narrow side walls 22, 22' (FIG. 3). Thus, the push rods 17 which are detachably connected to the support plate 16' traverse the bores 21 in the support plate 16 while the push rods 17' which are detachably connected to the support plate 16 are received in the bores 21' of the support plate 16'.

Advantageously, the shifting speed of the rods 10, 10' is variable in dependence on the charging degree of the subsequent conveyor 3. This may be attained by providing the conveyor 3 with e.g. sensors which determine the height of the product being charged onto the belt 9 or which determine the loading weight of the product, to generate an output signal for suitably adjusting and controlling the hydraulic cylinders 25, 25'.

A suitable control unit for varying the speed of the rods 10, 10' is illustrated in FIG. 4, by way of example. Each of the hydraulic cylinders 25, 25' includes a pressure valve 28 which is controlled by an actuator 29. These actuators 29 are operatively connected via a transducer 27 with a sensor 26 which is located behind the outlet opening 23 of the discharge well 6 in conveying direction 32 of the conveyor 3 and emits light rays 30 by which the height of product layers 31 placed by the loosening device 7 upon the carrying run 4 of the conveyor belt 9 is detected. If, for example, the sensor 26 determines that the actual height of the product layers 31 exceeds a desired value, the transducer 27 acts upon the push rods 17, 17' via the actuators 29 to modify, i.e. to decelerate, the speed by which the rods 10, 10' are shifted, while the speed of the conveyor 3 remains constant and depends on the amount of product components being filled in the packing units 2.

In an initial stage, the prepared foods, e.g. noodles, are stored in the container 5 until being transferred onto the conveyor 3 via the loosening device 7. Before running the conveyor 3, the support plates 16, 16' occupy their end position illustrated in FIG. 2, in which all rods 10, 10' extend completely across the discharge well 6 and prevent product components from escaping through the outlet opening 23. When starting the conveyor 3 and the feeder 1, the support plate 16 is acted upon by the push rods 17' to completely withdraw and remove the rods 10 from the discharge well 6. During withdrawal of the rods 10, product components slip from the retracting rods 10 of the first double row 12, 13 and descend until being picked up by the rods 10' of the subjacent rows 12', 13'. The support plate 16 is then returned to the end position shown in FIG. 2 in which the rods 10 traverse the discharge well 6, with the free ends of the rods 10 sliding between the product components.

Then, the opposite support plate 16' is moved by the push rods 17 in order to completely withdraw the rods 10' from the discharge well 6 and to enable product components to slip off the rods 10' of rows 12', 13' and to descend onto the subjacent rows 14, 15 of rods 10'. After returning the support plate 16' to its first end position, the support plate 16 is withdrawn to repeat the cycle. In this manner, the product components are advanced through the discharge well 6 in increments until being discharged through the outlet opening 23.

The incremental advance of the product components results in a significant loosening and disentangling of the components because descending product components are freed from any load exerted by the weight of the product in the top 5*a* of the container 5 and descending product components are separated from components retained by the rods 10 of rows 12, 13.

By means of the loosening device 7, a deformation of product components is essentially eliminated as only the rods 10 of the uppermost row 12, 13 enter an area of the discharge well 6 which is filled with product, while the rods 10, 10' of the subjacent rows 12', 13', 14, 15, 14', 15' will not impact product components when being shifted into the end position of FIG. 2 because the previously advanced product components descend onto the next following row of rods or conveyor 3 and thus are removed from the path of travel of rods entering the discharge well 6. Moreover, a sliding of further product components from above is essentially prevented by superimposed rows of rods.

While the invention has been illustrated and described as embodied in an apparatus for and method of gently packaging a product, it is not intended to be limited to the details shown since various modifications and structural changes may be made without departing in any way from the spirit of the present invention.

What is claimed as new and desired to be protected by Letters Patent is set forth in the appended claims:

We claim:

1. Apparatus for loosening a product of a type composed of a plurality of separable components tending to adhere to one another, before being discharged and transferred for further processing; said apparatus comprising:

a container for receiving the product, said container having a discharge well defining a transport path between an inlet opening and an outlet opening;

loosening means provided in said discharge well for separating components of the product said loosening means including a plurality of rods arranged successively in direction of the transport path and movable between a first position in which said rods are positioned in said discharge well across the transport path and a second position in which said rods are withdrawn from said discharge well;

control means operatively connected to said loosening means for moving successive rods in such a manner-that a first plurality of said rods is in the first position when a second plurality of said rods is in the second position, and said second plurality of said rods is in the first position when said first plurality of said rods is in the second position to allow product components to descend by increments toward said outlet opening.

2. A method of loosening a product of a type composed of a plurality of separable components tending to adhere to one another before transferring the product components for further processing; comprising the steps of:

admitting across a transport path of the product a plurality of successively arranged rods for retaining product components during their advance along the transport path; and withdrawing a first plurality of rods from the transport path by jointly retracting the first plurality of rods to release product components previously retained by the first plurality of rods while maintaining the position of a second plurality of rods across the transport path to allow product components to advance by increments toward an outlet opening while being loosened at the same time.

3. A method of gently packaging a product having a consistency which can be affected by external influences and including a plurality of separable components transported along a transport path; comprising the steps of:

admitting a plurality of rods across the transport path for retaining product components; and withdrawing a first fraction of said rods from the transport path by jointly retracting said first fraction of rods to release product components previously retained by these rods while maintaining the position of a second fraction of said rods across the transport path to allow advance and loosening of the product components.

4. A method as defined in claim 3 wherein said withdrawing step includes jointly retracting one half of the rods while maintaining the position of the other half of rods.

5. A method as defined in claim 3 wherein said admitting step includes a plurality of successive rows of parallel rods, said withdrawing step includes shifting one fraction of rows of rods while maintaining the position of another fraction of rows of rods.

6. A method as defined in claim 5 wherein said shifting step includes jointly operating each fraction of rows of rods.

7. A method as defined in claim 5 wherein said admitting step includes positioning rows of rods of one fraction between rows of rods of the other fraction.

8. A method of gently packaging a product having a consistency which can be affected by external influences and including a plurality of separable components; comprising the steps of:

loading the product in a container with an outlet opening through which product components are discharged;

admitting a plurality of neighboring and successively arranged rods in an area of the container in front of the outlet opening for retaining the product components; and withdrawing a fraction of rods away from the outlet opening of the container to release product components previously retained by this fraction of rods while maintaining the position of another fraction of rods in front of the outlet opening.

9. A method as defined in claim 8 wherein said withdrawing step includes jointly retracting one half of the rods while maintaining the position of the other half of rods.

10. A method as defined in claim 8 wherein said admitting step includes a plurality of successive rows of parallel rods, said withdrawing step includes shifting one fraction of rows of rods while maintaining the position of another fraction of rows of rods.

11. A method as defined in claim 10 wherein said shifting step includes jointly operating each fraction of rows of rods.

12. A method as defined in claim 10 wherein said admitting step includes positioning rows of rods of one fraction between rows of rods of the other fraction.

13. Apparatus for gently packaging a product having a consistency which can be affected by external influences and including a plurality of separable components which are transported along a transport path, said apparatus comprising:

a container with a discharge well for defining the transport path;

loosening means for separating components of the product, said loosening means including a plurality of rods subdividing the cross sectional area of the transport path in free sections of given size and movable in longitudinal direction between a first position in which said rods extend transverse to the transport path and a second position in which said rods are withdrawn from the transport path to at least partly free the cross sectional area thereof, a first support member for supporting a first plurality of said rods and a second support member for supporting a second plurality of said rods, and a control unit operatively connected to said first and second support members for withdrawing and returning said rods from and to the cross sectional area of said discharge well in such a manner that said rods of said first support member are in the first position when said rods of said second support member are in the second position, and that said rods of said second support member are in the first position when said rods of said first support member are in the second position.

14. Apparatus as defined in claim 13 wherein said transport path is defined by a drop, with the product descending by way of its weight.

15. Apparatus as defined in claim 13 wherein said loosening means includes a plurality of rods subdividing the cross sectional area of the transport path in free sections of given size.

16. Apparatus as defined in claim 13 wherein said rod has a free end of a configuration to facilitate penetration of the product when being admitted into said transport path.

17. Apparatus as defined in claim 13, and further comprising a container for receiving the product, said container having an inlet opening and an outlet opening, with the transport path extending between said inlet opening and said outlet opening.

18. Apparatus as defined in claim 17 wherein said container is of funnel-shaped configuration.

19. Apparatus as defined in claim 17 wherein said loosening means includes a plurality of rods, said container having a lower end shaped in form of a discharge well, said rods being movable into said discharge well.

20. Apparatus as defined in claim 19 wherein said rods traverse said discharge well in the first position and is completely withdrawn from said discharge well in the second position.

21. Apparatus as defined in claim 19 wherein said discharge well has opposing walls which are provided with bores for receiving said rods.

22. Apparatus as defined in claim 13 wherein said loosening means includes rows of parallel rods.

23. Apparatus as defined in claim 22 wherein said loosening means includes at least two rows of rods arranged sequentially in moving direction of the product.

24. Apparatus as defined in claim 22 wherein said rods of two successive rows of rods are arranged offset relative to one another.

25. Apparatus as defined in claim 22 wherein said loosening means includes a control unit operatively connected to said rows of rods for moving said rods between said first and second positions, said control unit operating said rows of rods independently from one another.

26. Apparatus as defined in claim 25 wherein said control unit operates at least two rows of rods sequentially.

27. Apparatus as defined in claim 25 wherein said control unit withdraws and again positions a row of rods in front of an outlet opening of the transport path before operating a successive row of rods.

28. Apparatus as defined in claim 25 wherein successive rows are spaced from each other with increasing distances in moving direction of the product.

29. Apparatus as defined in claim 25 wherein successive rows of rods are spaced from each other by a same distance.

30. Apparatus as defined in claim 25 wherein said control unit operates rows of rods from opposite directions.

31. Apparatus as defined in claim 15 wherein said loosening means includes a control unit operatively connected to said rods for moving said rods between said first and second positions.

32. Apparatus as defined in claim 31 wherein said control unit operates said rods in synchronism.

33. Apparatus as defined in claim 31 wherein said control unit operates said rods in a sequential clock frequency depending on a desired size of free sections, 34. Apparatus as defined in claim 31 wherein said control unit moves at least some of said rods sequentially.

35. Apparatus as defined in claim 31 wherein said control unit jointly operates several rods.

36. Apparatus as defined in claim 31 wherein said control unit is a hydraulic control unit.

37. Apparatus as defined in claim 31 wherein said control unit is adaptable for varying the speed by which said rods are moved.

38. Apparatus as defined in claim 31, and further comprising a conveyor in prolongation of the transport path, said control unit modifying the path of displacement of said rods in dependence on the charging degree of said conveyor.

39. Apparatus as defined in claim 31, wherein said first and second support members are operatively connected to said control unit for displacement from opposite directions toward opposing walls of said discharge well.

40. Apparatus as defined in claim 39 wherein said control unit includes a first pair of push rods detachably secured with their free ends to said first support member, and a second pair of push rods detachably secured with their free ends to said second support member.

41. Apparatus as defined in claim 40 wherein said first pair of push rods is guided in bores of said second support member and said second pair of push rods is guided in bores of said first support member.

* * * * *